United States Patent [19]

Terazawa et al.

[11] Patent Number: 5,048,484

[45] Date of Patent: Sep. 17, 1991

[54] THROTTLE CONTROLLER

[75] Inventors: Tadashi Terazawa, Toyota; Hiroshi Nakashima, Nishio; Yoshinori Taguchi, Nagoya, all of Japan

[73] Assignee: Aisin Seiki Kabushiki Kaisha, Kariya, Japan

[21] Appl. No.: 523,532

[22] Filed: May 15, 1990

[30] Foreign Application Priority Data

May 29, 1989 [JP] Japan ..... 1-135254

[51] Int. Cl.[5] ..... F02D 11/10

[52] U.S. Cl. ..... 123/361; 123/396; 123/399; 180/178

[58] Field of Search ..... 123/396, 399, 361; 180/178, 170

[56] References Cited

U.S. PATENT DOCUMENTS

| | | | |
|---|---|---|---|
| 4,120,373 | 10/1978 | Fleischer | 123/399 |
| 4,419,973 | 12/1983 | Collonia | 123/396 |
| 4,424,785 | 1/1984 | Ishida et al. | 123/399 |
| 4,445,603 | 5/1984 | Filsinger | 123/361 |
| 4,523,565 | 6/1985 | Omitsu | 123/399 |

FOREIGN PATENT DOCUMENTS

| | | | |
|---|---|---|---|
| 2062965 | 7/1971 | Fed. Rep. of Germany | 123/361 |
| 1-212622 | 8/1989 | Japan | 180/170 |

*Primary Examiner*—Andrew M. Dolinar

*Attorney, Agent, or Firm*—Burns, Doane, Swecker & Mathis

[57] ABSTRACT

Disclosed herein is a throttle controller that uses a clutch means to connect a throttle operation means to a driving means under normal acceleration control. The controller allows the driving means to regulate the opening of the throttle valve independent of an accelerator operation mechanism. This makes it possible to start and run the vehicle smoothly in response to accelerator pedal operation, as well as to provide diverse kinds of control including constant speed drive control. In particular, a second control means independent of a first control means allows a driving control means to control the clutch means, thereby reliably providing constand speed drive control irrespective of accelerator pedal operation.

4 Claims, 8 Drawing Sheets

FIG. 4(A)
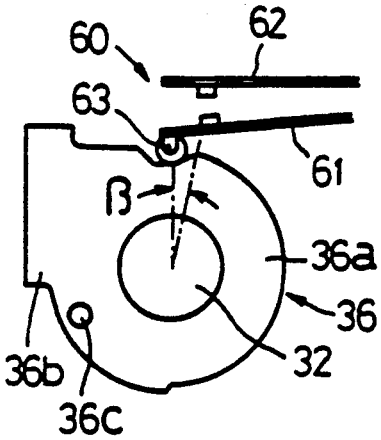
FIG. 4(B)
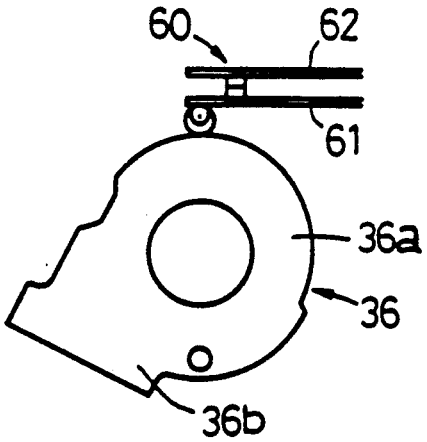
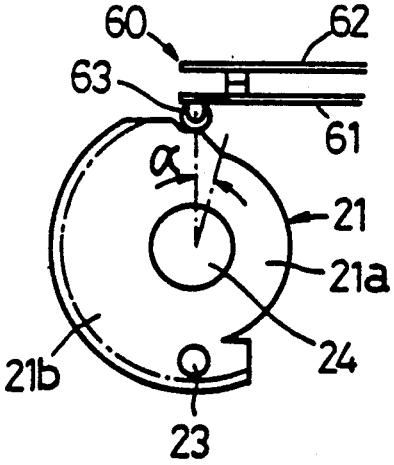
FIG. 5(A)
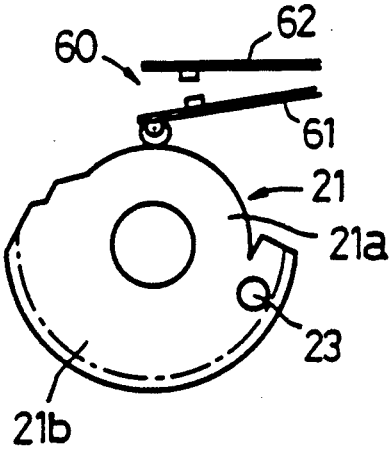
FIG. 5(B)

THROTTLE CONTROLLER

BACKGROUND OF THE INVENTION

1. Field of the Invention

The present invention relates to a throttle controller attached to an internal combustion engine and, more particularly, to a throttle controller which has a means for opening and closing a throttle valve using a motor or the like in response to the operation of an accelerator pedal and also a driving control means for providing diverse kinds of control including constant speed drive control.

2. Description of the Prior Art

The throttle valve for an internal combustion engine regulates the mixture of fuel and air when installed inside the carburetor, or controls the quantity of air intake when incorporated in the electronically controlled fuel injector for control over engine output in conjunction with the accelerator operation system comprising an accelerator pedal.

The accelerator operation system used to be connected mechanically to the throttle valve. Recently, there have been proposed devices that open and close the throttle valve using a motor-driven or similar means in response to the accelerator pedal operation. One such device is disclosed in Japanese Patent Laid-open No. 55-145867. This device involves having the throttle valve connected to a step motor which is driven in response to the operation of the accelerator pedal.

With respect to such devices, Japanese Patent Laid-open No. 59-153945 proposes a number of prior art measures to be taken should a step motor-driven electrically controlled actuator become uncontrollable. One such measure is to disconnect the throttle shaft from the electronically controlled actuator by electromagnetic clutch and to return the throttle valve to its closed position by return spring. The proposals in the disclosure are based on the assumption that after control by the electronically controlled actuator has ceased, the lack of a means for operating the throttle valve necessarily makes it impossible to drive the vehicle even to nearby repair facilities.

More specifically, the disclosure in Japanese Patent Laid-open No. 59-153945 involves installing an electromagnetic clutch between rotation axis and throttle shaft. The rotation axis is rotated by stepping on the accelerator pedal. The electromagnetic clutch disconnects the rotation axis from the throttle shaft when excited, and connects the two when not excited. A control circuit detects errors that may occur in the control operation of the electronically controlled actuator and, in case of an error, stops supplying power to both the actuator and the electromagnetic clutch by means of a relay arrangement. If the actuator becomes uncontrollable, the throttle shaft is mechanically connected to the accelerator pedal via the electromagnetic clutch.

As indicated, the prior art contrivance disclosed in Japanese Patent Laid-open No. 59-153945 uses a separate control circuit to detect an inoperable state of the electronically controlled actuator; the control circuit stops the supply of power to both the actuator and the electromagnetic clutch. After control by the actuator has ceased, according to the disclosure, the rotation axis mechanically connected to the accelerator pedal gets coupled with the throttle shaft by means of the electromagnetic clutch. In an embodiment of the above-disclosed device, the motor does not generate any driving torque while the electronically controlled actuator is stopping its control. In that state, according to the disclosure, only a limited amount of stepping force is needed to operate the accelerator pedal which in turn adequately opens and closes the throttle valve. That is, the actuator remains coupled with the accelerator pedal after control is transferred thereto.

One disadvantage of using the electromagnetic clutch in such prior art equipment is that the clutch tends to be large in size, with its cost soaring correspondingly. Another disadvantage is that there might be a case, though not very likely, in which both the electronically controlled actuator and the control circuit malfunction at the same time. For example, an electronic interference can force the throttle valve to get stuck in its opened position. In such a case, even if a separate switching means stops the supply of power to the electromagnetic clutch so as to connect the throttle shaft to the accelerator pedal, there is no way of placing the throttle valve in the closed position; it then becomes difficult to maintain a desired opening of the throttle valve. In the above-described event, the driver of the vehicle will generally stop operating the accelerator pedal and apply the brakes. With the disclosed device, however, the throttle valve remains driven by the actuator.

To overcome these disadvantages, this applicant has proposed a novel throttle controller in Japanese Patent Appl. No. 1-22190. This throttle controller involves reliably disconnecting the driving means from the throttle valve if the operation of the accelerator pedal has ceased and if the throttle opening at that point in time is found in excess of a predetermined threshold of throttle opening. The arrangement thus stops control over the throttle valve by the driving source.

The above-mentioned throttle controller, too, requires a constant speed drive control function whereby the vehicle may travel at a constant speed without the operation of the accelerator pedal once the desired speed is set. This throttle controller in the application is constructed so that during vehicle run, the driving means is disconnected when the accelerator pedal operation is stopped. This makes it impossible to continue constant speed drive control. Thus there exists the need to have the driving source maintain control over the throttle valve even when the accelerator pedal is not operated.

SUMMARY OF THE INVENTION

It is therefore an object of the present invention to provide a throttle controller which has the driving source control the throttle valve with or without constant speed drive control and which stops control by the driving source over the throttle valve by reliably disconnecting the former from the latter if the accelerator pedal operation is found stopped except when constant speed drive control is on and if the throttle opening at that point in time is found in excess of a predetermined throttle opening level.

It is another object of the present invention to provide a throttle controller which prevents accidental activation of constant speed drive control if the driver of the vehicle inadvertently touches the switch for that control.

To achieve the foregoing and other objects in accordance with the purposes of the present invention, as embodied and broadly described herein, the throttle controller according to the invention comprises a throttle operation means M1, an actuator means M2, an accelerator operation mechanism M3, a driving means M4, a driving source M5, a clutch means M6, and a driving control means M7, as outlined in FIG. 1. The throttle operation means M1 opens and closes a throttle valve 11. The actuator means M2 actuates the throttle operation means M1 to close the throttle valve 11. Independent of the accelerator operation mechanism M3, the driving means M4 drives the throttle operation means M1 to open and close the throttle valve 11. The driving source M5 drives the driving means M4 to rotate. The clutch means M6 connects and disconnects the throttle operation means M1 to and from the driving means M4. The driving control means M7 engages and disengages the clutch means M6 and, concurrently, controls the driving source M5 at least in response to the accelerator operation by the accelerator operation mechanism M3.

The throttle controller according to the present invention also comprises a first detection means M8, a second detection means M9, a first control means M10 and a second control means M11. The first detection means M8 outputs a signal in response to the amount of accelerator operation by the accelerator operation mechanism M3. The second detection means M9 outputs a signal corresponding to the opening of the throttle valve 11. The first control means M10 controls the driving control means M7 to disengage the throttle operation means M1 from the driving means M4 on two conditions: if the signal from the first detection means M8 indicates that the amount of accelerator operation is less than a predetermined level, and if the signal from the second detection means M9 indicates that the opening of the throttle valve 11 in response to the accelerator operation at that time is in excess of a predetermined angle. The second control means M11, installed in parallel with and independent of the first control means 10, allows the driving control means M7 to control the clutch means M6.

In the above-described throttle controller, the second control means M11 is preferably constructed to allow the driving control means M7 to control the clutch means M6 only when constant speed drive control is in effect whereby the driving source M5 is controlled to maintain the opening of the throttle valve 11 to keep a constant vehicle speed.

The clutch means M6 may be constituted by an electromagnetic clutch mechanism. The first and the second control means M10 and M11 respectively contain a first and a second energizing circuit to supply the electromagnetic clutch mechanism with the output from the driving control means M7. The second energizing circuit has a switching means for turning on and off the supply of power to the electromagnetic clutch mechanism in conjunction with the brake pedal operation of the vehicle.

Alternatively, the driving control means M7 may be connected to a main switch and a control switch for constant speed drive control. In this setup, the second energizing circuit is activated to power the electromagnetic clutch mechanism only when both the main switch and the control switch are operated.

The throttle controller described above is installed in an internal combustion engine, not shown. The throttle operation means M1 is disengaged from the driving means M4 when the accelerator operation mechanism M3 is in its initial position in inoperative state. When the internal combustion engine starts operating, the throttle operation means M1 is engaged with the driving means M4 via the clutch means M6. The driving means M4 is rotated by the driving source M5 under control of the driving control means M7. The throttle valve 11 is controlled in terms of opening by the throttle operation means M1.

In the state described above, the throttle valve 11 may be opened and closed by controlling the driving source M5 and by rotating the driving means M4 regardless of the accelerator operation mechanism M3. Suitably controlling the driving source M5 provides diverse kinds of control including constant speed drive control. That is, with constant speed drive control in effect, the second control means M11 may be set so as to have the driving control means M7 control the clutch means M6 irrespective of the first control means M10; the driving means M4 is thus engaged with the throttle operation means M1. Under control of the driving control means M7, the driving source M5 rotates the driving means M4, thereby controlling the throttle valve 11 in its opening so as to maintain the desired vehicle speed.

Where the second control means M11 is used only for constant speed driving control, the driving means M4 stays disengaged from the throttle operation means M1 in any mode other than constant speed drive control unless and until the accelerator pedal is operated. A case may be assumed in which the signal from the first detection means M8 indicates that the amount of accelerator operation is less than a predetermined level, and in which the signal from the second detection means M9 indicates that the opening of the throttle valve 11 in response to the accelerator operation at that time is in excess of a predetermined angle. In that case, the driving control means M7 controls the clutch means M6 so that the first control means 10 disengages the throttle operation means M1 from the driving means M4. Therefore, possible malfunction of the driving control means M7 or of the driving source M5 does not result in opening the throttle valve 11 against the vehicle driver's will.

BRIEF DESCRIPTION OF THE DRAWINGS

FIGS. 4 (A) and 4 (B) are views showing relative positions of a limit switch against an accelerator plate in the embodiment of FIGS. 2 and 3, FIG. 4 (A) depicting the accelerator plate in its initial position and FIG. 4 (B) illustrating the accelerator plate being rotated;

FIGS. 5 (A) and 5 (B) are views showing relative positions of the limit switch against a throttle plate in the embodiment, FIG. 5 (A) depicting the throttle plate in its initial position and FIG. 5 (B) illustrating the throttle plate being rotated;

DESCRIPTION OF THE PREFERRED EMBODIMENT:

A preferred embodiment of the present invention will now be described by referring to the accompanying drawings.

Figure 1:
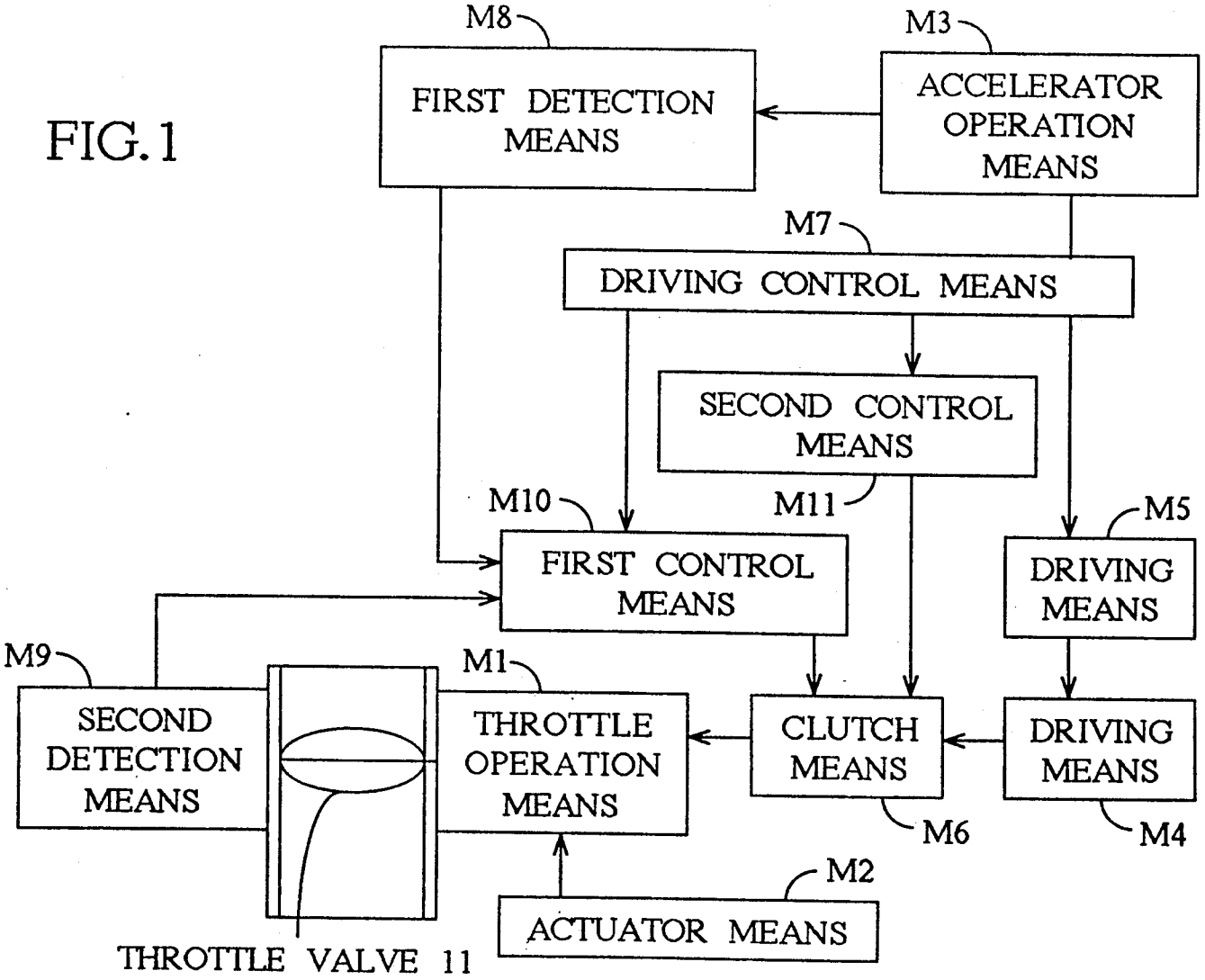
FIG. 1 is a schematic block diagram of the throttle controller according to the present invention.
Figure 2:
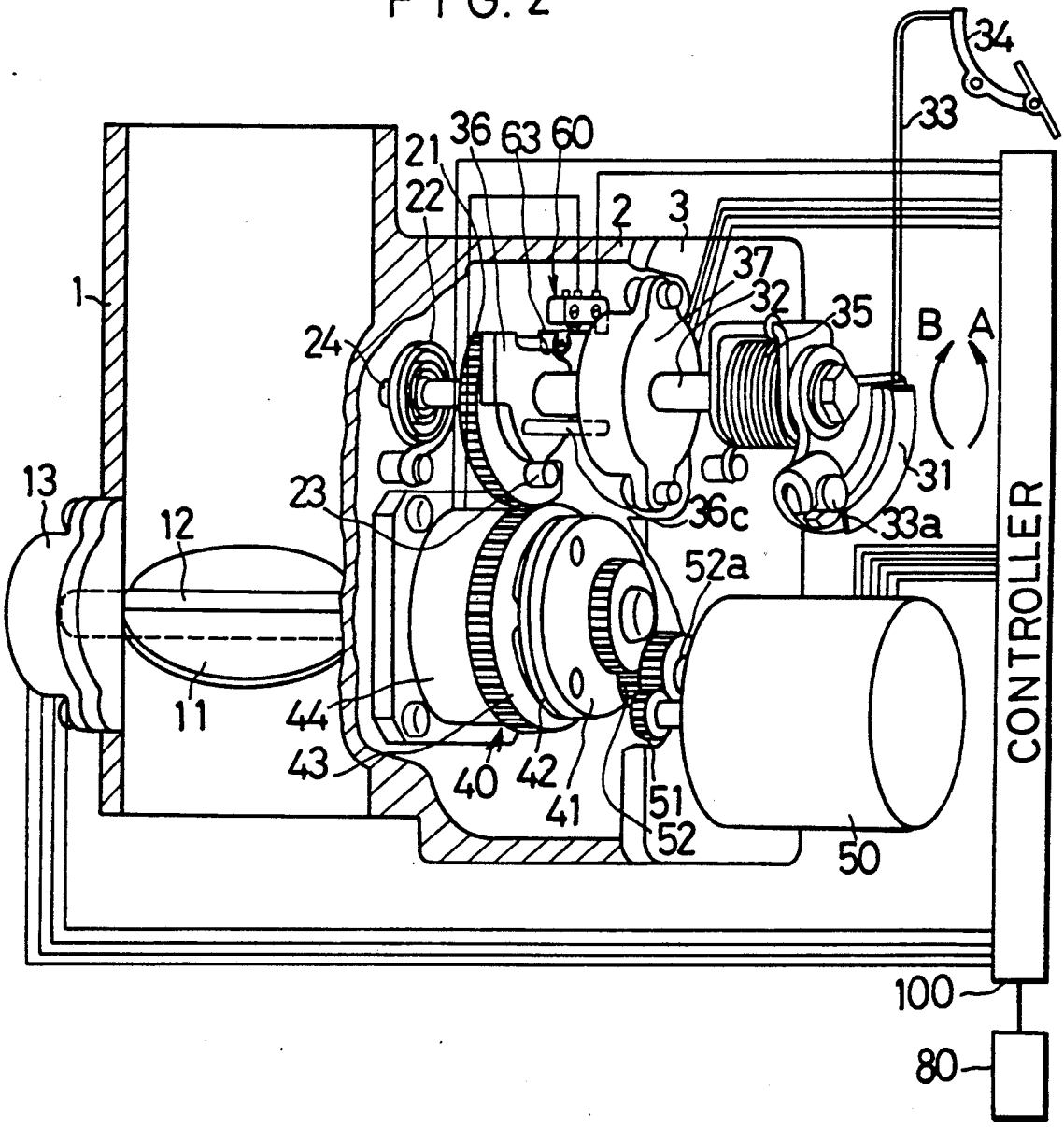
FIG. 2 is an exploded perspective view of an embodiment of the throttle controller according to the invention.
Figure 3:
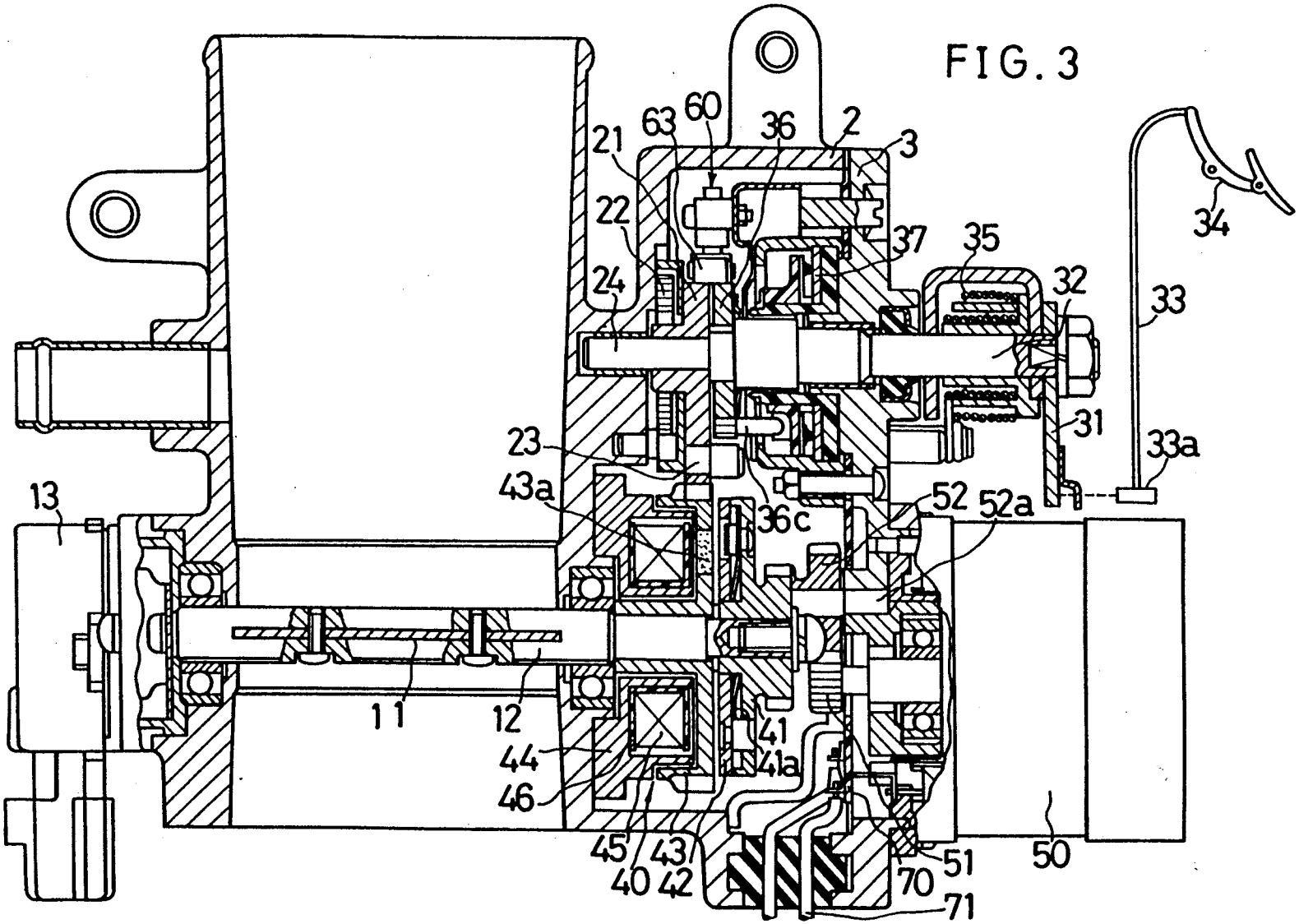
FIG. 3 is a longitudinal sectional view of the embodiment.

As shown in FIGS. 2 and 3, an internal combustion engine has an intake pipe in which a throttle valve 11 is rotatably supported by a throttle shaft 12. A throttle body 1 supports one end of the throttle shaft 12. The throttle body 1 has a case 2 integrally mounted on its side. The case 2 is connected to a cover 3. These parts constitute an engine interior wherein a portion of the parts constituting the throttle controller according to the invention is accommodated. A throttle sensor 13 is mounted on the side of the throttle body 1 which is located opposite to the case 2 and which supports the other end of the throttle shaft 12.

The throttle sensor 13 is connected to the throttle shaft 12 and has a detector that detects the opening of the throttle valve 11. The rotary displacement of the throttle shaft 12 is converted to an electric signal. As a result, an idle switch signal and a throttle opening signal are typically output to a controller 100.

A movable yoke 43 is fixedly mounted on the other end of the throttle shaft 12. The throttle valve 11 is constructed so as to rotate in integral combination with the movable yoke 43. As indicated in FIG. 3, the movable yoke 43 is a round, platter-shaped magnetic substance having an axial portion that is fixed to the throttle shaft 12. There is provided a fixed yoke 44 which is a substantially round magnetic substance engaged with the movable yoke 43, with the openings of both yokes opposed to each other and the side walls and axial portions thereof axially fitted leaving a predetermined clearance therebetween. The fixed yoke 44 is fixedly mounted on the throttle body 1. The clearance between axial portion and side wall accommodates a coil 45 wound around a nonmagnetic bobbin 46. A nonmagnetic frictional member 43*a* is embedded around the throttle shaft 12 at the bottom of the movable yoke 43. A driving plate 41, which is the driving means of this invention, is located opposite to a disk-shaped magnetic clutch plate 42. These parts constitute an electromagnetic clutch mechanism 40 which is the clutch means of the present invention.

The driving plate is a round, platter-shaped part having an axial portion at its center. This axial portion is rotatably supported around the throttle shaft 12. The axial portion of the driving plate 41 integrally contains an external gear engaged with another external gear on a small diameter section of a gear 52, as will be further described later. As illustrated in FIG. 3, the bottom of the driving plate 41 is connected to the above-described clutch plate 42 via a plate spring 41*a*. The plate spring 41*a* moves the clutch plate 42 toward the driving plate 41; the clutch plate 42 is disengaged from the movable yoke 43 when the coil 45 is not energized.

The gear 52 is a staggered cylinder in shape having a small and a large diameter section. With each section having an external gear, the gear 52 is rotatably supported around a shaft 52*a* fixed to the cover 3. A motor 50, which is the driving source of the present invention, is fixed to the cover 3. The rotation axis of the motor 50 is rotatably supported in parallel with the shaft 52*a*. A gear 51, fixedly mounted on the tip of the rotation axis of the motor 50, is engaged with the external gear of the large diameter section of the gear 52. In this embodiment, the motor 50 is a step motor under control of the controller 100. The motor 50 may alternatively be a DC motor or other types of motor.

When the motor 50 is driven to rotate the gear 51, the gear 52 is also rotated, causing the driving plate 51 engaged therewith to rotate together with the clutch plate 42 around the throttle shaft 12. At this point, if the coil 45 of FIG. 3 is not energized, the clutch plate 42 is disengaged from the movable yoke 43 by force of the plate spring 41*a*. In this case, the movable yoke 43, the throttle shaft 12 and the throttle valve 11 can rotate freely independent of the driving plate 41. When the movable yoke 43 and the fixed yoke 44 are excited, the electromagnetic force generated thereby causes the clutch plate 42 to be drawn to and come in contact with the movable yoke 43 by defying the force of the plate spring 41*a*. As a result of this, the clutch plate 42 is frictionally engaged with the movable yoke 43 and, aided by the frictional member 43*a*, rotates as coupled. That is, the driving plate 41, the clutch plate 42, the movable yoke 43, the throttle shaft 12 and the throttle valve 11 are all rotated together by the motor 50 via the gears 51 and 52.

An accelerator operation mechanism is constituted as follows. An accelerator shaft 32 is rotatably supported in parallel with the throttle shaft 12 and projects out of the cover 3. An accelerator link 31 is fixedly mounted on the projecting tip of the accelerator shaft 32. A pin 33*a*, fixed to one end of an accelerator cable 33, is secured to the tip of the accelerator link 31. A return spring 35, connected to the accelerator link 31, pushes the accelerator link 31 and the accelerator shaft 32 in the direction of closing the throttle valve 11. The other end of the accelerator cable 33 is connected to an accelerator pedal 34. In response to the operation of the accelerator pedal 34, the accelerator link 31 and the accelerator shaft 32 rotate around the accelerator shaft 32.

Between throttle body 1 and cover 3 inside the case 2, an accelerator plate 36 is fixed to the accelerator shaft 32. Opposite to the accelerator plate 36, a throttle plate 21 is fixed to a small diameter section of the accelerator shaft 32.

The throttle plate 21, plans of which are shown in FIG. 5, comprises a small diameter section 21*a* and a large diameter section 21*b*, the small diameter section being supported by the small diameter section 24 of the accelerator shaft 32. As depicted in FIG. 2, an external gear is formed on the outer surface of the large diameter section 21*b*. The external gear of the throttle plate 21 is engaged with the external gear of the movable yoke 43 as mentioned earlier. The movable yoke 43 rotates in conjunction with the throttle plate 21 being rotated. In turn, the throttle shaft 12 and throttle valve 11 integrally coupled with the movable yoke 43 also rotate. Constructed in this manner, the throttle plate 21 and the movable yoke 43 constitute the throttle operation means of the present invention.

In FIG. 5, the throttle plate 21 has a staggered portion between the small diameter section 21*a* and the large diameter section 21*b*. An edge cam is formed on the circumferential surface of the throttle plate 21. An axial surface of the large diameter section 21*b* is located opposite to a stopper of the case 2, not shown. This arrangement restricts the rotation of the throttle plate 21. A pin 23 is fixed to the large diameter section 21*b* of the throttle plate 21. As shown in FIGS. 2 and 3, one end of a return spring 22 is latched to the axial portion of the throttle plate 21, the other end thereof being latched to a pin embedded in the case 2. Thus the throttle plate 21 is pushed by the return spring 22 in the direction of bringing the side of the large diameter section 21*b* into contact with the case 2. That is, the throttle plate 21 is pushed by the return spring 22, which is the actuator means of the present invention, in direction B of FIG. 2, i.e., in the direction of closing the throttle valve 11.

The accelerator plate 36, plans of which are given in FIG. 4, has at its center a disk portion 36*a* fixed to the accelerator shaft 32 and an arm portion 36*b* that axially extends. The disk portion 36*a* has a small diameter section continued to the arm portion 36*b*, the small diameter section having a depression. The circumferential surface of the disk portion 36*a* comprises an edge cam. One side of the arm portion 36*b* in its rotating direction is located opposite to the stopper of the case 2, not shown, the other side thereof being placed opposite to the pin 23 of the throttle plate 21. As shown in FIG. 4, when the accelerator plate 36 rotates counterclockwise to bring its arm portion 36*b* into contact with the pin 23 of the throttle plate 21, the accelerator plate 36 and the throttle plate 21 rotate together.

The arm portion 36*b* of the accelerator plate 36 is pushed by the return spring 35 shown in FIGS. 2 and 3 in the arrowed direction B of FIG. 2. FIG. 2 illustrates the initial positions of the accelerator plate 36 and of the throttle plate 21 described above. When the electromagnetic clutch mechanism 40 couples the driving plate 41 with the movable yoke 43, the throttle valve 11 is rotated by the motor 50. In case the controller 100, to be described later, or the motor 50 breaks down, the accelerator pedal 34 is stepped on to a degree exceeding a predetermined level to bring the arm portion 36*b* of the accelerator plate 36 into contact with the pin 23 of the throttle plate 21. This action opens the throttle valve 11. The accelerator plate 36 has a pin 36*c* that extends in the axial direction of the accelerator shaft 32.

An accelerator sensor 37 is fixed to the circumference of the bearing of the accelerator shaft 32 on the cover 3. Having a known construction, the accelerator sensor 37 comprises a member made of thick film resistance, not shown, and a brush positioned opposite thereto. The brush is located so as to be latched to the pin 36*c* of the accelerator plate 36. In operation, the accelerator sensor 37 detects a rotation angle of the accelerator shaft 32 that rotates in integral combination with the accelerator plate 36. The accelerator sensor 37 is electrically wired to a printed circuit board 70 located between case 2 and cover 3. In turn, the printed circuit board 70 is electrically wired to the controller 100 by means of leads 71.

In FIG. 3, a limit switch 60 activated in conjunction with the throttle plate 21 and accelerator plate 36 is fixed to the case 3 via a stay and is electrically connected to the printed circuit board 70. As schematically depicted in FIGS. 4 and 5, the limit switch 60 has a pair of elastic leads 61 and 62 with opposed contacts attached thereto. A roller 63 is fixed to the tip of the lead 61. The roller 63 may be replaced by a sliding member.

As shown in FIGS. 2 and 3, the roller 63 is pushed into contact with the circumferential surfaces of the throttle late 21 and of the accelerator plate 36. Therefore the roller 63 is driven in motion by the edge cams of the throttle plate 21 and accelerator plate 36. While the roller 63 is being driven, the contact of the lead 61 touches or is removed from that of the lead 62. The limit switch 60 and the accelerator plate 36 constitute the first detection means of the invention; the limit switch 60 and the throttle plate 21 constitute the section detection means of the invention.

FIG. 4 (A) shows the initial position of the accelerator 34 of FIG. 2 as it is yet to be operated. In this state, the roller 63 of the limit switch 60, opposed to the small diameter section of the disk portion 36*a* of the accelerator plate 36, is pressed into contact with the circumferential surface of the small diameter section thereof by the lead 62. Thus the opposed contacts of the leads 61 and 62 remain open.

In FIG. 4, operating the accelerator pedal 34 rotates the accelerator plate 36 counterclockwise. This action causes the roller 63 to come into contact with the circumferential surface of the disk portion 36*a*, as shown in FIG. 4 (B). That is, the contacts of the leads 61 and 62 are closed so that the coil 45 of the electromagnetic clutch mechanism 40 may be powered.

FIG. 5 (A) depicts the initial position of the throttle plate 21 as it is pushed by the return spring 22, with the throttle valve 11 of FIG. 2 in its closed position. At this point, the roller 63 of the limit switch 60 is in contact with the large diameter section 21*b* of the throttle plate 21, the contacts of the leads 61 and 62 being closed so that the coil 45 of the electromagnetic clutch mechanism 40 may be powered.

FIG. 5 (B) illustrates a case in which the movable yoke 43 of the electromagnetic clutch mechanism 40 is rotated counterclockwise by the motor 50 via the clutch plate 42 beyond a predetermined angle. Rotating the throttle plate 21 beyond the angle $\alpha$ causes the roller 63 of the limit switch 60 to come in contact with the small diameter section 21*a* of the throttle plate 21. The lead 61 is detached from the lead 62 to break their contacts, thereby de-energizing the coil 45 of the electromagnetic clutch mechanism 40.

As illustrated in FIGS. 2 and 3, the roller 63 of the limit switch 60 is located opposite to the circumferential surfaces of the throttle plate 21 and of the accelerator plate 36. Thus the lead 61 acts depending on how the throttle plates 21 and the accelerator plate 36 are positioned relative to each other. The lead 61 is detached from the lead 62 to break their contacts when both states of FIGS. 4 (A) and 5 (B) occur simultaneously. That is, the breaking of the contacts takes place on two conditions: if the operation of the accelerator pedal 34 is less than a predetermined level, with the rotation angle of the accelerator plate 36 less than a predetermined angle $\beta$; and if the throttle plate 21 at this point is rotated in excess of a predetermined angle $\alpha$. The contact points of the leads 61 and 62 remain in contact except in the above-described case.

In the embodiment described above, there is one limit switch 60, and the roller 63 is positioned opposite to the circumferential surfaces of both the throttle plate 21 and the accelerator plate 36. Alternatively, two lead switches connected in parallel may be provided so that two rollers are separately positioned opposite to the throttle plate 21 and the accelerator plate 36. Again in the above-described embodiment, the limit switch 60 is accommodated in the case 2. One alternative to this setup is to attach a lead switch for detecting the amount of accelerator pedal operation to the cover 3 outside the case 2. Another alternative is to provide a sensor for directly detecting the amount of the operation of the accelerator pedal 34. Yet another alternative is to replace the above-described two lead switches with an analog sensor arrangement such as a potentiometer apparatus connected to a comparator device. In this setup, a switching means such as a transistor device is turned on when a given output drops below a predetermined level. A further alternative is to utilize the accelerator sensor 37 and the throttle sensor 13 as analog sensors. Another alternative is to get the limit switch 60 constituted by a combination of an optical detector such as a photo-interrupter with a switching element. This setup provides a redundant system when suitably combined with the lead switches or analog sensors described above.

A case is assumed in which the amount of the operation of the accelerator pedal 34 is less than the predetermined level, e.g., in which the accelerator plate 36 is positioned as shown in FIG. 2. In this case, with the amount of accelerator pedal operation substantially zero, the throttle valve 11 is opened until the predetermined angle thereof is exceeded, i.e., until the throttle plate 21 is rotated in excess of the angle $\alpha$ in the arrowed direction A of FIG. 2. At this point, the roller 63 comes in contact with the small diameter section of the accelerator plate 36, opening the contacts of the leads 61 and 62.

Figure 6:
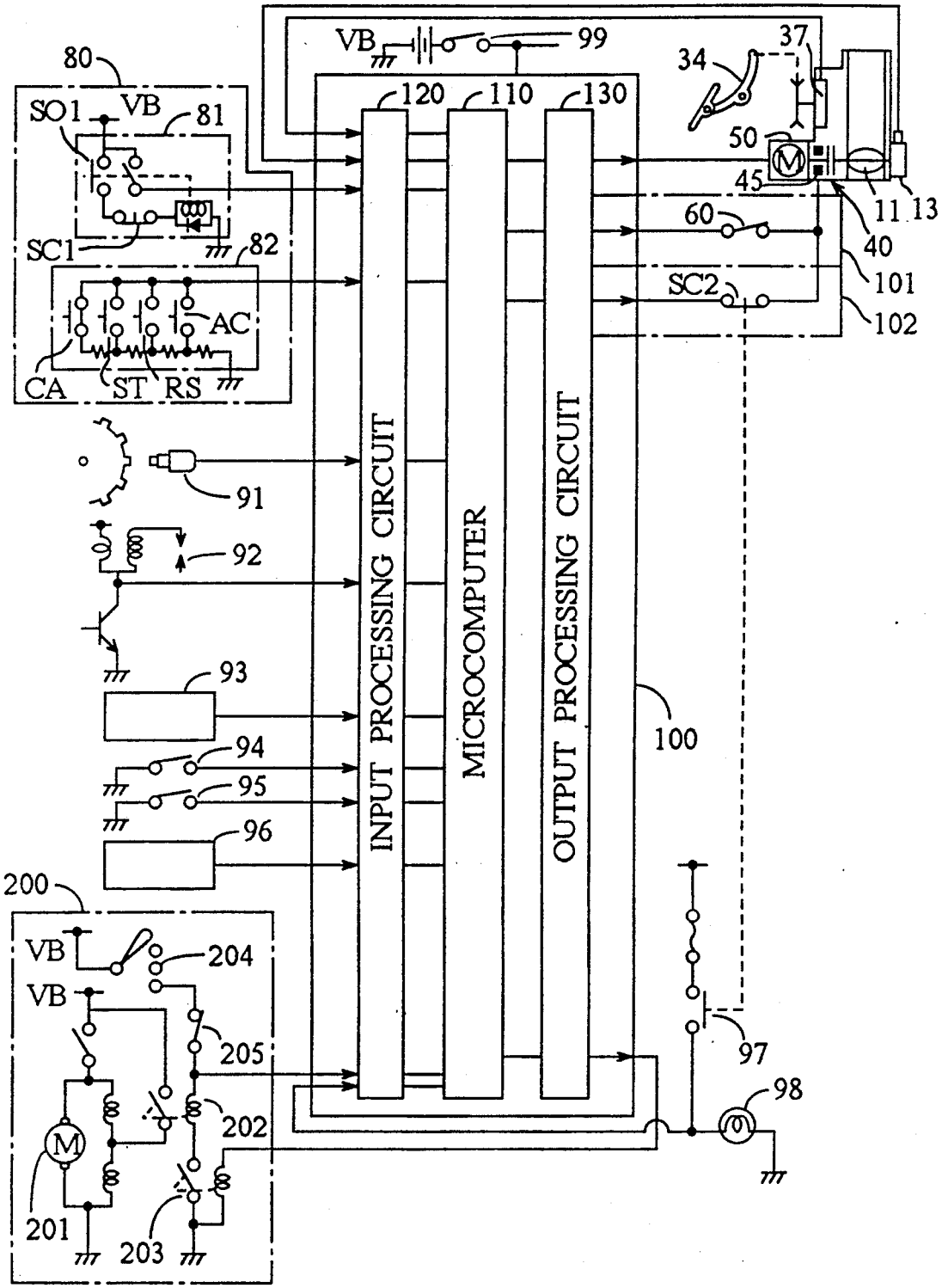
FIG. 6 is an overall schematic of a controller and an input/output device of the embodiment.

The controller 100 is a control circuit comprising a microcomputer and has capabilities constituting the driving control means of the present invention. As shown in FIG. 6, the controller 100, located on board the vehicle, admits detected signals from various sensors for diverse kinds of control including control over the electromagnetic clutch mechanism 40 and over the motor 50. In this embodiment, ordinary vehicle control by operation of the accelerator pedal is supplemented by the controller 100 providing various kinds of vehicle control including constant speed drive control and acceleration skid control.

In FIG. 6, the controller 100 comprises a microcomputer 110 along with an input processing circuit 120 and an output processing circuit 130 connected thereto. The motor 50 is connected to the output processing circuit 130. The coil 45 of the electromagnetic clutch mechanism 40 is connected to the output processing circuit 130 via a first energizing circuit 101 and a second energizing circuit 102. The controller 100 is connected to a power source $V_B$ via an ignition switch 99. The power on/off means for the controller 100 may be a transistor, a relay or other switching element that conducts when the ignition switch 99 is activated.

The accelerator sensor 37 is connected to the input processing circuit 120 and outputs a signal reflecting the amount of the operation of the accelerator pedal 34, i.e., the extent of how much the pedal is stepped on. The signal from the accelerator sensor 37 is input along with a signal from the throttle sensor 13 to the input processing circuit 120. Depending on the driving condition, the controller 100 turns on and off the electromagnetic clutch mechanism 40. The controller 100 also controls the motor 50 so that the throttle valve 11 is opened to a suitable degree in accordance with the amount of accelerator pedal operation, i.e., how much the accelerator pedal 34 is stepped on.

A constant speed drive control switch (or simply a constant speed drive switch) 80 is connected to the input processing circuit 120. The switch 80 comprises a main switch 81 and a control switch 82. The main switch turns on and off the supply of power to the entire constant speed drive control system. As illustrated in FIG. 6, the control switch 82 comprises a plurality of switches that provide diverse switching functions.

During vehicle run, with the main switch 81 turned on, activating a set switch ST within the control switch 82 for a short period of time stores in memory the vehicle speed at that point, as will be further described later. An acceleration switch AC within the control switch 82 is used to fine tune the vehicle speed thus established. With the acceleration switch AC turned on, speed-up control remains in effect. Fine tuning for speed reduction is achieved in one of two ways: by keeping the set switch ST turned on, or by activating the set switch ST briefly after the brake pedal is stepped on to release constant speed drive control and to slow down to a desired vehicle speed. A cancel switch CA in the control switch 82 cancels constant speed drive control when activated. Other means for releasing constant speed drive control include operation of the brake pedal, shifting into neutral position in the case of an automatic transmission, operation of the parking brake, and deactivation of the main switch 81. A resume switch RS within the control switch 82 is used to restore the vehicle speed in effect before constant speed drive control was established.

A wheel speed sensor 91, constituted by a known type of electromagnetic pickup sensor or hole sensor, is used for constant speed drive control and acceleration skid control. Although only one sensor 91 is shown in FIG. 6, it may be attached as needed to each of the wheels on the vehicle in practice. An ignition circuit unit, generally known as an igniter 92, is connected to the controller 100. The igniter 92 detects the number of engine revolutions by admitting ignition signals.

A transmission controller 93 is a device that controls the automatic transmission. A transmission signal and a timing signal from the automatic transmission are supplied to the controller 100. A mode changeover switch 94 controls the opening of the throttle valve 11 depending on the driving mode. That is, the microcomputer 110 contains predetermined maps defining relations between stepping operation of the accelerator pedal 34 and opening of the throttle valve 11 in various driving modes. Any of these maps is selected as needed by the mode changeover switch 94. Driving modes that may be set include "power" mode, "economy" mode, "freeway drive" mode and "city drive" mode. An acceleration skid control inhibit switch 95 is operated to supply the microcomputer 110 with a signal to inhibit acceleration skid control where the driver of the vehicle prefers to turn it off. A steering wheel sensor 96 checks to see if the steering wheel is operated during, say, acceleration skid control, and sets an appropriate target skid rate depending on the result of the check. A brake switch 97 is opened and closed depending on the operation of the brake pedal, not shown. Operating the brake switch 97 lights a brake lamp 98 and opens the second energizing circuit 102 connected to the electromagnetic clutch mechanism 40, as will be further described later.

A starter circuit 200 controls a starter motor 201. Within the circuit 200, a second relay 203 is serially connected to a coil of a first relay 202 that turns on and off a driving circuit of the starter motor 201. The second relay 203 is controlled in accordance with a signal from the controller 100. A starter switch 204 is serially connected to the first relay 202 and second relay 203. On board the vehicle with an automatic transmission, a neutral start switch 205 is installed between the first relay 202 and the starter switch 204. The neutral start switch 205 is activated when the automatic transmission, not shown, is in neutral position. Activating the starter switch 204 in this position energizes the coil of the first relay 202 provided the second relay 203 is on. This turns on the driving circuit of the starter motor 201 to drive the latter.

Upon initial check on whether the throttle controller according to the invention normally works, activating the starter switch 204 leaves the second relay 203 turned off. The starter motor 201 remains inactive until the throttle valve 11 is operated for confirmation. This arrangement prevents excess engine revolutions during initial check on the throttle controller.

Figure 7:
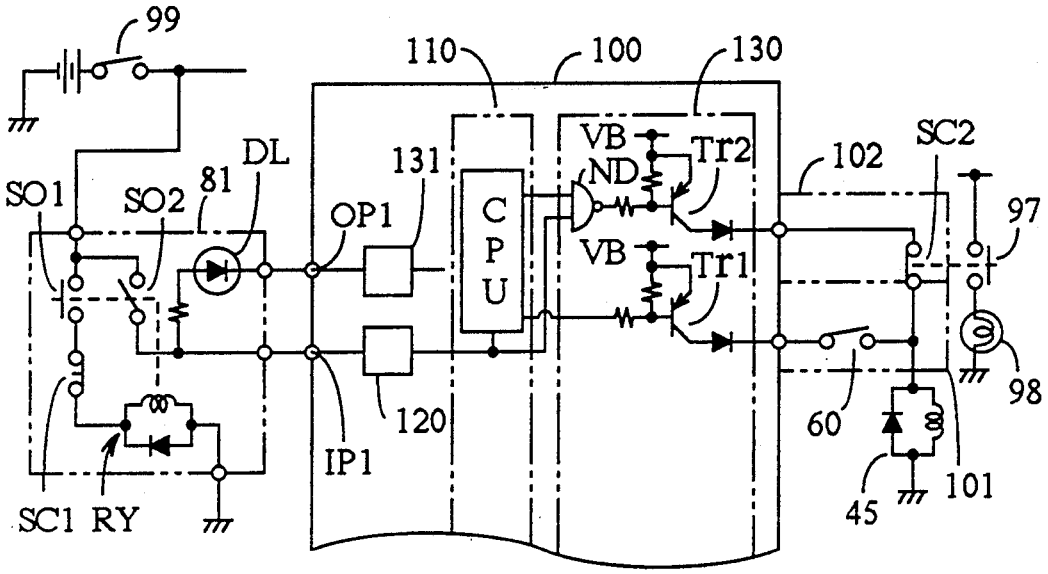
FIG. 7 is an electric circuit diagram of means for starting and stopping constant speed drive control by the controller of FIG. 6.

Referring now to FIG. 7, there will be described in detail the means for starting and stopping constant speed drive control within the controller 100. In the main switch 81 of FIG. 7, a normally open switch SO1 and a normally closed switch SC1 are serially connected to the power source $V_B$ and are also connected to ground via a relay RY. In parallel with these switches, an input terminal IP1 of the controller 100 is connected to the power source $V_B$ via a normally open switch SO2, an output terminal OP1 thereof being connected to a normally closed switch SC2 via a light-emitting diode DL. These parts are arranged so that once the ignition switch 99 is turned off, constant speed drive control remains deactivated unless the main switch 81 for constant speed drive control is operated.

The input terminal IP1 is connected both to the microcomputer 110 via the input processing circuit 120 and to one input terminal of a NAND gate ND on the output processing circuit 130. The output terminal OP1 is connected to a driving circuit 131. The output of the microcomputer 110 is input to the base of a transistor Tr1 whose emitter is connected to the power source $V_B$. The collector of the transistor Tr1 is connected via the limit switch 60 to the coil 45 of the electromagnetic clutch mechanism 40, thereby constituting the first energizing circuit 101. The output of the NAND gate ND is input to the base of a transistor Tr2 whose emitter is connected to the power source $V_B$. The collector of the transistor Tr2 is connected to the coil 45 via the normally closed switch SC2 that acts in conjunction with the brake switch 97, thus constituting the second energizing circuit 102. The microcomputer 110 incorporates a CPU along with a ROM and RAM arrangement. These parts are connected to I/O ports via a common bus, although only the CPU is depicted in FIG. 7.

The transistor Tr1 controls the supply of power to the coil 45; it remains in conductive state as long as the throttle controller normally functions. The transistor Tr2 primarily controls the supply of power to the coil 45 under constant speed drive control so as to control the electromagnetic clutch mechanism 40. When the set switch ST within the control switch 82 of FIG. 6 is operated, with the main switch 81 turned on, the microcomputer 110 activates the transistor Tr2. Thus the transistor Tr2 remains off as long as the main switch 81 is deactivated. This cuts off the supply of power from the energizing circuit 102 to the coil 45; the throttle valve 11 is not driven by the motor 50. The first energizing circuit 101, second energizing circuit 102 and controller 100 constitute the first and the second control means of the present invention.

Figure 8:
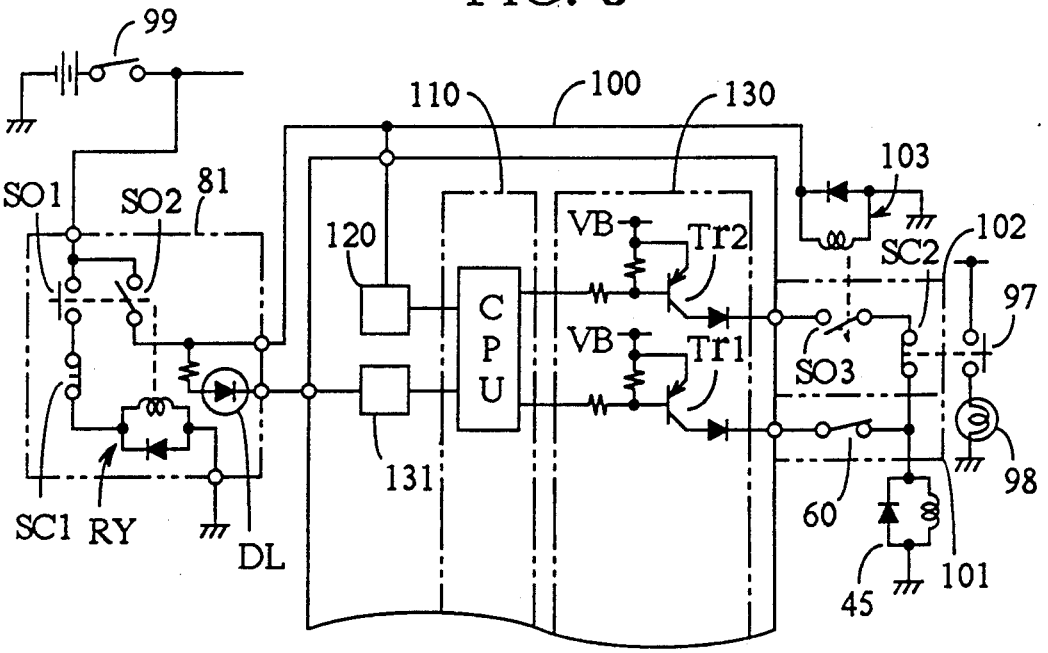
FIG. 8 is an electric circuit diagram of the means which are the same in nature as those in FIG. 7 and which are contained in another embodiment.

FIG. 8 illustrates another embodiment of the means for starting and stopping constant speed drive control within the controller 100. A relay 103 is serially connected to the main switch 81 for constant speed drive control. A normally open switch SO3, driven by the relay 103, is installed in the second energizing circuit 102. This arrangement eliminates the need for the NAND gate ND required in the embodiment of FIG. 7. That is, the corresponding circuitry is constructed outside the controller 100. The rest of the construction is the same as in the embodiment of FIG. 7. Activating the normally open switch SO1 of the main switch 81 excites the relay 103 and turns on the normally open switch SO3, thus constituting the second energizing circuit 102. This in turn operates the set switch ST within the control switch 82. When the output from the microcomputer 110 turns on the transistor Tr2, the coil 45 is energized. Turning off the normally closed switch SC1 or the ignition switch 99 deactivates the normally open switch SO2. This action deenergizes the relay 103 and turns off the normally open switch SO3, cutting off the supply of power to the coil 45. In this state, constant speed drive control is inhibited unless and until the driver of the vehicle activates the main switch 81.

Figure 9:
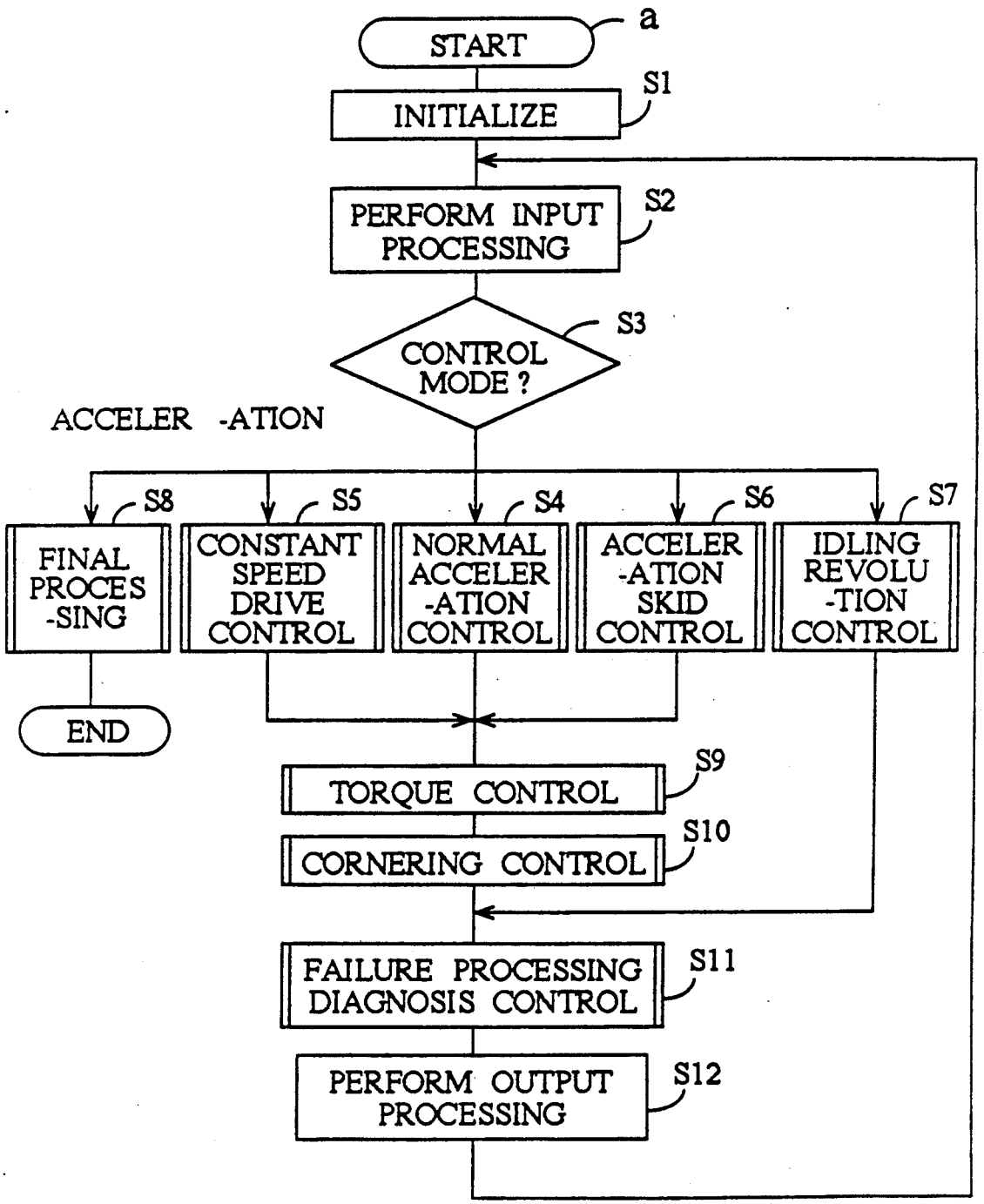
FIG. 9 is a flowchart describing how the embodiment depicted in FIGS. 2 through 7 functions.

How the above-described embodiment works will now be described in detail. The flowchart of FIG. 9 depicts how the throttle controller according to this embodiment works as a whole. In step S1, the controller 100 is initialized. In step S2, various signals input to the input processing circuit 120 are processed thereby. In step S3, a control mode is selected depending on the input signal. That is, one of steps S4 through S8 is selected.

Any of steps S4 through S6 is followed by torque control in step S9 and cornering control in step S10. In step S9, the throttle is controlled so as to reduce the shock from speed changes. In step S10, the throttle is controlled depending on the steering angle of the steering wheel, not shown. The above two steps are not immediately relevant to the embodiment, and descriptions thereof are omitted accordingly. Idling revolution control in step S7 is a control mode that keeps the idling revolutions of the engine constant regardless of the engine status. Step S8 is a control mode that provides necessary processing after the ignition switch 99 is turned off.

In step S11, a diagnosis means carries out self-diagnosis and performs failure processing if needed. In step S12, an output process is performed. At this point, the electromagnetic clutch mechanism 40 and motor 50 are activated via the output processing circuit 130. The above-described routine is repeated at predetermined intervals.

More specifically, in step S4, normal acceleration control functions as follows. When the accelerator pedal 34 has yet to be operated, i.e., when the throttle valve 11 is fully closed, the throttle plate 21 and the accelerator plate 36 are positioned as shown in FIG. 2. The transistor Tr2 of FIG. 7 is turned off. The second energizing circuit 102 is opened, but the transistor Tr1 remains on. If the limit switch 60 is also turned on, the coil 45 of the electromagnetic clutch mechanism 40 is energized via the first energizing circuit 101.

With the coil 45 energized to excite the fixed yoke 44 and movable yoke 43, the clutch plate 42 is coupled with the movable yoke 43 so that the motor 50 may drive the throttle shaft 12. After this, unless an abnormal state occurs, as will be described later, the throttle shaft 12 is rotated by the motor 50. Thus the throttle valve 11 is regulated in its opening by the motor 50 under control of the controller 100.

Under normal acceleration control, stepping on the accelerator pedal 34 turns the accelerator link 31 against the pushing force of the return spring 35 in response to the amount of the pedal stepping operation. This in turn rotates the accelerator plate 36 in the arrowed direction A in FIG. 2 to keep the limit switch 60 activated. At the same time, the accelerator sensor 37 acting in conjunction with the pin 36*c* of FIG. 2 detects a rotation angle of the accelerator plate 36 that is operated depending on how much the accelerator pedal 34 is stepped on. The detected output from the accelerator sensor 37 is input to the controller 100. Accordingly, the controller 100 determines a target throttle opening corresponding to the rotation angle of the accelerator plate 36. For example, the accelerator opening, i.e., the target throttle opening that matches the rotation angle of the accelerator plate 36 is obtained from a characteristic "b" or "c" in FIG. 10. When the motor 50 is driven to rotate the throttle shaft 12, a signal that matches the rotation angle thereof is output from the throttle sensor 13 to the controller 100. The motor 50 is controlled by the controller 100 so that the throttle valve 11 substantially coincides with the target throttle opening. The throttle is controlled in this manner in response to how much the accelerator pedal 34 is stepped on, whereby the engine output corresponding to the opening of the throttle valve 11 is obtained.

While the throttle valve 11 is operating, the accelerator plate 36 is not coupled with the throttle plate 21. Instead, the rotating throttle plate 21 is followed in motion by the accelerator plate 36 with a predetermined angle left therebetween. Thus there exists no mechanically connecting relationship between accelerator pedal 34 and throttle valve 11; the vehicle is started up and run smoothly in response to the operation of the accelerator pedal 34. When the accelerator pedal 34 is released, the pushing force of the return spring 35 together with the driving force of the motor 50 returns the accelerator link 31 to its initial position, with the throttle valve 11 fully closed.

If the throttle valve 11 fails under normal acceleration control, releasing the accelerator pedal 34 causes the return spring 35 to return the accelerator plate 36 to its initial position. At this point, the accelerator plate 36 and the throttle plate 21 are positioned as depicted in FIGS. 4(A) and 5(B), respectively. As indicated in FIG. 7, turning off the limit switch 60 opens the first energizing circuit 101. Furthermore, because the transistor Tr2 is off and the second energizing circuit 102 is opened, the supply of power to the coil 45 is stopped, whereby the movable yoke 43 is separated from the clutch plate 42 in the electromagnetic clutch mechanism 40. The driving plate 41 stops driving the throttle valve 11, the latter being returned to its initial position by the return spring 22.

Under constant speed drive control in step S5, the driver of the vehicle presses the normally open switch SO1 within the main switch 81 to excite the relay RY, closing the normally open switches SO1 and SO2 and keeping them in that state. This allows the power source $V_B$ to be connected to the input processing circuit 120 via the input terminal IP1. There, the power is transformed to a predetermined voltage output. The voltage output is supplied both to one input terminal of the NAND gate ND and to the CPU of the microcomputer 110. When the set switch ST in the control switch 82 of FIG. 6 is operated, the voltage output is supplied by the microcomputer 110 to the other input terminal of the NAND gate ND. This activates the transistor Tr2, which in turn excites the coil 45 by supplying it with a current via the normally closed switch SC2.

In the above-described case, if the throttle valve 11 is opened beyond a predetermined degree of opening, releasing the accelerator pedal 34 turns off the limit switch 60 and opens the first energizing circuit 101. Under constant speed drive control, however, the second energizing circuit 102 allows the coil 45 to be powered continuously. Thus the throttle shaft 12 is connected to the motor 50 via the electromagnetic clutch mechanism 40.

The wheel speed sensor 91 detects a vehicle speed on the one hand, and the set switch ST sets a vehicle speed on the other. A target throttle opening is set in accordance with the difference between the two speeds. The motor 50 controls the throttle valve 11 to maintain the target throttle opening thus established.

There will be a case in which the vehicle needs to be accelerated in order to, say, pass the car ahead. Under normal acceleration control, if the current throttle opening obtained by operation of the acceleration pedal 34 exceeds the target throttle opening that was set under constant speed drive control, an override mode is entered. That is, the target throttle opening is replaced by the opening which was set in the normal acceleration control mode.

Constant speed drive control is released as follows. In FIG. 6, the vehicle driver operates the cancel switch CA in the control switch 82 or the normally closed switch SC1 and turns off the main switch 81. This action turns off the transistor Tr2 of FIG. 7, opening the second energizing circuit 102. The same effect is achieved by turning off the ignition switch 99. Alternatively, operating the brake pedal also turns off the normally closed switch SC2 that acts in conjunction with the brake switch 97, thus opening the second energizing circuit 102. After this, the throttle is placed under normal acceleration control by means of the first energizing circuit 101.

One advantage of the above-described setup is that if the vehicle operator inadvertently touches the set switch ST or if the microcomputer 110 malfunctions due to electronic interference or other factors, the throttle valve 11 will not be opened automatically unless the driver intentionally operates the normally open switch SO1 of the main switch 81.

How the throttle controller of the present invention works under acceleration skid control in step S6 will now be described in detail. Based on an output signal from the wheel speed sensor 91 in FIG. 6, the controller 100 detects a skid of the driving wheels upon starting or during acceleration. With the skid detected, the acceleration skid control mode is selected, and the opening of the throttle valve 11 is controlled in that mode.

Figure 10:
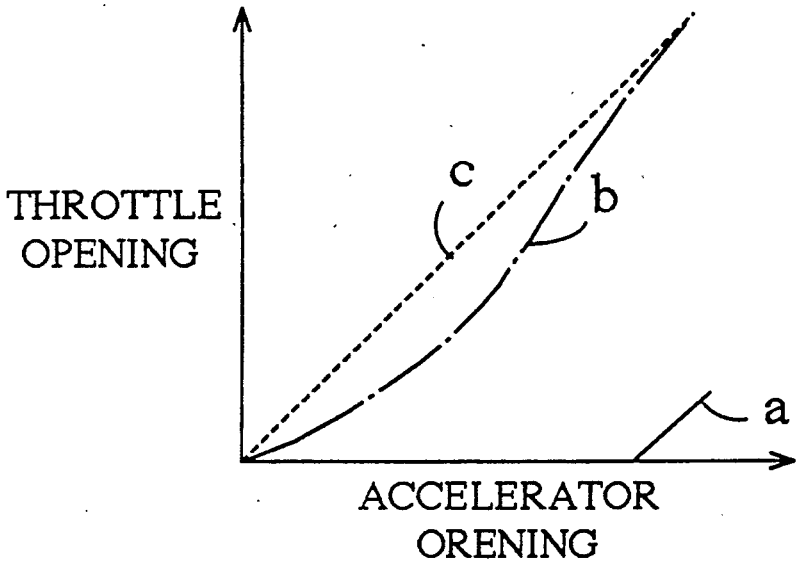
FIG. 10 is a view showing the relationship in terms of characteristic between accelerator opening and throttle angle.

More specifically, the controller 100 computes the skid rate of the driving wheels such that they provide the vehicle with sufficient levels of traction and lateral drag on the current road surface. The controller 100 further computes a target throttle opening by which to attain the computed skid rate. The motor 50 is controlled so that the throttle valve 11 keeps to the target throttle opening. If the skid rate drops below the predetermined level and if the target throttle opening exceeds the throttle opening that was set under normal acceleration control as shown in FIG. 10, the acceleration skid control mode comes to an end, and the normal acceleration control mode is resumed. During transition from the acceleration skid control mode to the normal acceleration control mode, the motor 50 keeps controlling the throttle valve 11 in its opening. Thus, the so-called pedal shock does not occur to the accelerator pedal 34 during the transition.

When the throttle sensor 13 and accelerator sensor 37 respectively detect an insufficient opening of the throttle valve 11 and an insufficient amount of operation of the accelerator pedal 34, the idling revolution control mode in step S7 of FIG. 9 comes into effect. A target number of engine revolutions is then determined in accordance with the cooling water temperature, load and other operating factors of the engine. The motor 50 is driven to attain the established engine revolutions. In that state, as shown in FIG. 5(A), the limit switch 60 is kept from getting turned off.

With the throttle controller according to the present invention, should the motor 50 or controller 100 become inoperable, suitable operation of the accelerator pedal 34 keeps the vehicle running on the road. As shown in FIGS. 2, 4 and 5, stepping on the accelerator pedal 34 more than a predetermined amount of its operation causes the arm portion 36*b* of the accelerator plate 36 to rotate in the direction of the pin 23 thereof, thus latching the arm portion 36*b* to the pin 23. This drives the movable yoke 43 in the direction of opening the throttle valve 11 and attains a constant opening thereof as shown by the characteristic "a" in FIG. 10. Thus, the vehicle driver can continue running the vehicle, although at reduced speeds.

One advantage of the throttle controller according to the present invention is that the vehicle can be started up and run smoothly in response to accelerator pedal operation. This is made possible because under normal acceleration control, the throttle operation means is connected to the driving means via the clutch means so that the throttle valve opening is controlled by the driving means independent of the accelerator operation mechanism. Another advantage is that this arrangement permits diverse kinds of control including constant speed drive control. In particular, the second control means independent of the first control means allows the driving control means to control the clutch means. This makes it possible to provide constant speed drive control regardless of accelerator pedal operation.

As indicated, the throttle controller may be typically set so that the throttle valve does not open in any mode other than constant speed drive control unless and until the accelerator pedal is operated. Therefore the throttle valve does not malfunction even if the driving control means fails. In addition, under normal acceleration control, if the driving means abnormally acts to open the throttle valve, simply releasing the accelerator pedal reliably causes the first and second detection means as well as the first control means to have the driving control means control the clutch means. Thus the driving means is reliably disengaged from the throttle operation means.

Where the driving control means is connected with the main switch and control switch for constant speed drive control, only if both switches are operated is the second energizing circuit closed to power the electromagnetic clutch mechanism. Thus even if the vehicle driver inadvertently operates the control switch, the constant speed drive control mode is not entered unless the main switch is operated as well. In this manner, the abnormal or inadvertent operation of the throttle valve is reliably prevented.

It is to be understood that while the invention has been described in conjunction with specific embodiments, it is evident that many alternatives, modifications and variations will become apparent to those skilled in the art in light of the foregoing description. Accordingly, it is intended that the present invention embrace all such alternatives, modifications and variations as fall within the spirit and scope of the appended claims.

What is claimed is:

1. In a throttle controller having a throttle operation means for opening and closing a throttle valve, an actuator means for actuating said throttle operation means to close said throttle valve, an accelerator operation mechanism, a driving means for driving said throttle operation means to open and close said throttle valve, a driving source for rotating said driving means, a clutch means for engaging and disengaging said throttle operation means with and from said driving means, and a driving control means for engaging and disengaging said clutch means while controlling said driving source at least in response to accelerator operation of said accelerator operation means, the improvement comprising a first detection means, a second detection means, a first control means and a second control means, said first detection means outputting a signal corresponding to the amount of accelerator operation of said accelerator operation mechanism, said second detection means outputting a signal corresponding to the opening of said throttle valve, said first control means allowing said clutch means to have said driving control means disengage said throttle operation means from said driving means if said output signal from said first detection means indicates that the amount of accelerator operation is less than a predetermined level and if said output signal from said second detection means indicates that the opening of said throttle valve reflecting the accelerator operation at that point is in excess of a predetermined angle, said second control means being provided in parallel with and independent of said first control means and allowing said driving control means to control said clutch means.

2. A throttle controller according to claim 1, wherein said second control means allows said driving control means to control said clutch means only under constant speed drive control whereby said driving source is controlled so that said throttle valve retains its opening in order to maintain a constant vehicle speed.

3. A throttle controller according to claim 1, wherein said clutch means is constituted by an electromagnetic clutch mechanism and wherein said first and second control means respectively comprise a first and a second energizing circuit for supplying the output of said driving control means to said electromagnetic clutch mechanism, said second energizing circuit serially containing a switch means for turning on and off the supply of power to said electromagnetic clutch mechanism in conjunction with a brake pedal on board the vehicle.

4. A throttle controller according to claim 3, further comprising a main switch and a control switch for constant speed drive control and connected to said driving control means, said second energizing circuit being closed to energize said electromagnetic clutch mechanism only if both said main switch and said control switch are operated at the same time.

* * * * *